US008500044B2

(12) United States Patent
Sawalski et al.

(10) Patent No.: US 8,500,044 B2
(45) Date of Patent: Aug. 6, 2013

(54) MULTIPLE NOZZLE DIFFERENTIAL FLUID DELIVERY HEAD

(75) Inventors: Michael M. Sawalski, Racine, WI (US); Michael J. Skalitzky, Kenosha, WI (US); Nitin Sharma, Kenosha, WI (US); Padma Prabodh Varanasi, Racine, WI (US); Yong Chen, Racine, WI (US); Allen D. Miller, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 713 days.

(21) Appl. No.: 11/749,558

(22) Filed: May 16, 2007

(65) Prior Publication Data

US 2008/0283624 A1 Nov. 20, 2008

(51) Int. Cl.

| | |
|---|---|
| ***E03D 9/02*** | (2006.01) |
| ***B05B 1/14*** | (2006.01) |
| ***B05B 1/12*** | (2006.01) |
| ***B05B 1/02*** | (2006.01) |

(52) U.S. Cl.
USPC ..... 239/548; 239/600; 4/223

(58) Field of Classification Search
USPC ..... 4/420.4, 420.5, 448, 223, 227.1; 239/305, 239/307, 266–269, 558, 575, 578, 329, 463, 239/548, 556, 557, 561, 566, 567, 600
See application file for complete search history.

(56) References Cited

U.S. PATENT DOCUMENTS

| | | | | |
|---|---|---|---|---|
| 1,385,985 A | | 8/1921 | Decker | |
| 3,139,100 A | | 6/1964 | Griparis | |
| 3,182,916 A | | 5/1965 | Schulz | |
| 3,658,933 A | | 4/1972 | Beard, Jr. | |
| 3,711,029 A | * | 1/1973 | Bartlett | 239/394 |
| 3,917,172 A | * | 11/1975 | O'Hare | 239/305 |
| 3,945,574 A | | 3/1976 | Polnauer et al. | |
| 3,982,698 A | * | 9/1976 | Anderson | 239/394 |
| 4,019,658 A | * | 4/1977 | Consaul | 222/144.5 |
| 4,183,105 A | | 1/1980 | Womack | |
| 4,260,110 A | | 4/1981 | Werding | |

(Continued)

FOREIGN PATENT DOCUMENTS

| | | |
|---|---|---|
| DE | 2625496 A1 | 12/1977 |
| WO | 9703892 A | 2/1997 |

(Continued)

OTHER PUBLICATIONS

PCT/US2008/005715 International Search Report and Written Opinion dated Sep. 12, 2008.

*Primary Examiner* — Darren W Gorman

(57) ABSTRACT

A multiple nozzle differential fluid delivery head is disclosed. The fluid delivery head includes a body that defines a fluid chamber having a longitudinal axis. The body includes an inlet for connection to a fluid source, and the inlet is in fluid communication with the fluid chamber. The fluid delivery head includes a plurality of outlet ports connected to and extending away from the body. Each outlet port has an interior space in fluid communication with the fluid chamber. The fluid delivery head includes a nozzle insert removably secured in an outer end of each outlet port. At least one nozzle insert has a fluid delivery aperture in fluid communication with the interior space of its associated outlet port for delivering fluid out of the interior space of its associated outlet port. One or more of the outlet ports is angled away from a plane normal to the axis of the fluid delivery head.

17 Claims, 3 Drawing Sheets

U.S. PATENT DOCUMENTS

| | | | | |
|---|---|---|---|---|
| 4,371,993 | A * | 2/1983 | Patrick | 4/448 |
| 4,670,916 | A * | 6/1987 | Bloom | 4/231 |
| 5,022,098 | A | 6/1991 | Brower | |
| 5,152,463 | A | 10/1992 | Mao et al. | |
| 5,253,807 | A * | 10/1993 | Newbegin | 239/11 |
| 5,358,787 | A | 10/1994 | Fontana et al. | |
| 5,544,813 | A * | 8/1996 | Giles et al. | 239/71 |
| 5,711,488 | A * | 1/1998 | Lund | 239/333 |
| 5,722,598 | A | 3/1998 | Werding | |
| 5,738,282 | A | 4/1998 | Grogan | |
| 5,991,937 | A * | 11/1999 | Safara | 4/420.2 |
| 6,086,812 | A * | 7/2000 | Crampton et al. | 264/328.1 |
| 6,158,674 | A | 12/2000 | Humphreys | |
| 6,371,389 | B1 | 4/2002 | Bickart et al. | |
| 6,378,787 | B1 | 4/2002 | Buchi et al. | |
| 6,405,945 | B1 | 6/2002 | Dobrin | |
| 6,467,101 | B1 * | 10/2002 | Artola | 4/354 |
| 6,474,568 | B2 | 11/2002 | Seyfarth et al. | |
| 6,517,012 | B1 | 2/2003 | Slowik et al. | |
| 6,622,315 | B1 | 9/2003 | Feygin et al. | |
| 6,704,946 | B1 * | 3/2004 | Mueller et al. | 4/420.4 |
| 6,772,450 | B1 * | 8/2004 | Saylor et al. | 4/223 |
| 6,789,552 | B1 * | 9/2004 | Robinson et al. | 134/22.18 |
| 6,817,493 | B1 | 11/2004 | Parsons et al. | |
| 6,820,821 | B2 | 11/2004 | Linstedt et al. | |
| 6,971,557 | B2 | 12/2005 | Mather et al. | |
| 6,978,946 | B2 | 12/2005 | Sweeton | |
| 7,311,004 | B2 * | 12/2007 | Giles | 73/592 |
| 2003/0042331 | A1 | 3/2003 | Lu | |
| 2003/0150937 | A1 | 8/2003 | Laidler et al. | |
| 2004/0050959 | A1 | 3/2004 | Mazooji et al. | |
| 2004/0050970 | A1 | 3/2004 | Bowman et al. | |
| 2004/0256490 | A1 | 12/2004 | Sweeton | |
| 2005/0017095 | A1 | 1/2005 | Mehr | |
| 2006/0049282 | A1 | 3/2006 | Bowman et al. | |
| 2007/0000941 | A1 | 1/2007 | Hadden et al. | |
| 2007/0040045 | A1 | 2/2007 | Cohen | |
| 2007/0045337 | A1 | 3/2007 | Hornsby et al. | |
| 2007/0158359 | A1 | 7/2007 | Rodrian | |
| 2007/0187427 | A1 | 8/2007 | Shaw et al. | |
| 2007/0204387 | A1 | 9/2007 | Cornelius et al. | |
| 2007/0204388 | A1 | 9/2007 | Zyskowski et al. | |
| 2007/0204389 | A1 | 9/2007 | Graefe et al. | |
| 2007/0240251 | A1 | 10/2007 | Pagani | |
| 2007/0245470 | A1 | 10/2007 | Nguyen et al. | |
| 2007/0289054 | A1 | 12/2007 | Han et al. | |
| 2008/0078780 | A1 | 4/2008 | Sanger et al. | |

FOREIGN PATENT DOCUMENTS

| | | | |
|---|---|---|---|
| WO | 0058573 | A | 10/2000 |
| WO | WO 01/14652 | A1 | 3/2001 |
| WO | 2008044201 | | 4/2008 |
| WO | 2008076346 | | 6/2008 |

* cited by examiner

MULTIPLE NOZZLE DIFFERENTIAL FLUID DELIVERY HEAD

CROSS-REFERENCES TO RELATED APPLICATIONS

Not Applicable.

STATEMENT REGARDING FEDERALLY SPONSORED RESEARCH

Not Applicable.

BACKGROUND OF THE INVENTION

1. Field of the Invention

This invention relates to a multiple nozzle differential fluid delivery head for spraying a cleaner on the inside surfaces of an enclosure such as a toilet bowl, a shower enclosure, or a bathtub enclosure.

2. Description of the Related Art

Toilet bowls require care to prevent the buildup of unsightly deposits, to reduce odors and to prevent bacteria growth. Traditionally, toilet bowls have been cleaned, deodorized and disinfected by manual scrubbing with a liquid or powdered cleaning and sanitizing agent. Likewise, shower enclosures and bathtub enclosures require care to prevent the buildup of unsightly deposits and to prevent bacteria growth. Typically, shower enclosures and bathtub enclosures have been cleaned by manual scrubbing with a liquid cleaning agent. These tasks have required manual labor to keep the toilet bowl, shower enclosure and bathtub enclosure clean.

Automatic toilet bowl cleaning systems have been proposed. Some automatic toilet bowl dispensers use an aerosol deodorizing and/or cleaning agent that is dispensed into a toilet bowl through a conduit attached to the toilet bowl rim. For example, U.S. Pat. No. 3,178,070 discloses an aerosol container mounted by a bracket on a toilet rim with a tube extending over the rim; and U.S. Pat. Nos. 6,029,286 and 5,862,532 disclose dispensers for a toilet bowl including a pressurized reservoir of fluid, a conduit connected to the source of fluid, and a spray nozzle which is installed on the toilet rim. One disadvantage with these known toilet rim dispensing devices is that these devices may only apply the deodorizing and/or cleaning agent to one location in the toilet water or a limited area in the toilet water or on the inner surface of the toilet bowl. As a result, the cleaning of the inner surface of the toilet bowl may be limited to an area of the toilet bowl near the device.

Automatic toilet bowl cleaning systems that use a plurality of separate spray heads have also been proposed. See, for example, U.S. Pat. Nos. 6,622,315, 5,022,098 and 4,183,105. However, these systems require complicated fluid piping arrangements that would likely deter many consumers from attempting to install such systems.

Automatic shower cleaning systems have also been developed. U.S. Pat. No. 7,021,494 describes an automated sprayer for spraying the walls of a shower enclosure with a liquid cleanser. The sprayer dispenses the cleanser using a pump and rotatable spray head. A motor drives the pump and rotates the spray head. The cleanser is thereby sprayed on the walls of the shower enclosure.

Multiple nozzle fluid delivery heads have also been proposed. See, for example, U.S. Pat. Nos. 6,669,120, 6,123,272, 6,435,427, 5,484,002, 5,253,807 and 3,139,100.

Designing automatic delivery systems for cleaning objects such as toilet bowls, shower enclosures and bathtub enclosures is usually complicated as different parts of the surface to be treated/cleaned are different distances and orientations from the location of the liquid delivery system. One way to treat such surfaces is to use rotating fluid delivery components within the system and a means to alter the spray characteristics with the rotating angle of the fluid delivery head. While this type of design can accomplish appropriate treatment for all parts of the surface, in practice, it may become cumbersome. It may be desirable to have non-rotating fluid delivery components within an automated cleaning system as it reduces the complexity and hence lowers the cost and enhances the reliability.

Thus, there is a need for a static fluid delivery head for use in an automated cleaning system for cleaning toilet bowls, shower enclosures, bathtub enclosures and the like.

SUMMARY OF THE INVENTION

The foregoing needs can be met with a multiple nozzle differential fluid delivery head according to the invention. The fluid delivery head is suitable for use in an automated cleaning system for cleaning an enclosure such as a toilet bowl, a shower enclosure, a bathtub enclosure, and the like. The fluid delivery head dispenses multiple sprays. The spray cone angle of these sprays depends on the distance that the spray has to traverse before hitting the appropriate part of the enclosure inner surface. The fluid delivery head includes an appropriate number of nozzles oriented in different directions in its head so that a uniform coverage of the enclosure surface with the cleaning chemical can be achieved. Each of these nozzles is based on a swirl nozzle configuration. A swirl nozzle provides a conical spray and the characteristics of the spray such as velocity, drop size, cone angle, discharge rate etc., will depend upon the internal geometric details of the nozzle. The magnitudes for all the geometric parameters for each of the swirl nozzles within the fluid delivery head can be determined so that a complete and uniform coverage of a toilet bowl surface (or other enclosure surface) can be accomplished with a single non-rotating fluid delivery head.

In one form, the multiple nozzle differential fluid delivery head includes two components: (1) a body, and (2) outlet ports (pressure swirl atomizers). The fluid delivery head may include eight outlet ports wherein each outlet port is inclined at an angle ($\Theta$) from the horizontal to the longitudinal axis of the fluid delivery head. The outlet ports used are pressure swirl atomizers. There are numerous design parameters of each outlet port which affect the spray characteristics (half cone angle, particle size, etc.). The half cone angle of these sprays is a function of axial and swirl (or radial) velocity. For each nozzle insert that goes on the end of an outlet port in the delivery head, half cone angle $\leqq$ angle $\Theta$. This ensures that the spray will not go off the toilet bowl rim.

The nozzle inserts are designed such that the half cone angle of the spray depends on the distance the spray has to travel before hitting the toilet bowl surface. The nozzle which is going to be placed closest to the toilet bowl surface is designed to have the maximum cone angle and vice versa for the nozzle which is placed farthest from the toilet bowl surface (or other enclosure surface).

The advantage of the multiple nozzle differential fluid delivery head is that even though it is placed differentially with regards to the toilet bowl surface, it provides uniform coverage of fluid (cleaning chemical) on the toilet bowl inner surface. Even though this design has been written for swirl nozzles, the general idea of having multiple nozzles with different spray characteristics is equally applicable for other nozzle configurations too (e.g. fan nozzle etc.).

Thus, the invention provides a static fluid delivery head including a body, outlet ports, and nozzle inserts. The body includes a fluid chamber having a longitudinal axis. The fluid chamber has an inlet for connection to a fluid source, and the inlet is in fluid communication with the fluid chamber. The outlet ports are connected to and extend away from an outer surface of the body. Each outlet port has an interior space in fluid communication with the fluid chamber. One or more of the outlet ports is angled away from a plane normal to the axis of the fluid chamber at an angle (Θ). The nozzle inserts are removably secured in an outer end of each outlet port. One or more of the nozzle inserts has a fluid delivery aperture in fluid communication with the interior space of its associated outlet port for delivering fluid out of the interior space of its associated outlet port.

Preferably, each of the outlet ports is angled away from a plane normal to the axis of the fluid chamber at an angle (Θ). Most preferably, each of the outlet ports is angled away from the inlet. In one version of the fluid delivery head, at least two of outlet ports are angled away from the inlet at different angles. One or more of the outlet ports may include an outer wall and a central axial projection in spaced relationship such that the interior space in the outlet port is defined by an inner surface of the outer wall and an outer surface of the axial projection.

In one form of the fluid delivery head, the body includes an annular outer wall spaced apart from an inner tubular wall that defines the fluid chamber. In this form of the fluid delivery head, the outer wall includes the outer surface of the body from which the outlet ports extend outward. Each of the outlet ports may extend the same distance or a different distance away from the outer surface of the body.

Each nozzle insert may include a fluid delivery aperture in fluid communication with the interior space of its associated outlet port for delivering fluid out of the interior space of its associated outlet port. The tip of each nozzle insert may include an inwardly directed depression in fluid communication with the fluid delivery aperture. In one form, each depression has a conical inner surface to thereby create a conical spray pattern from the nozzle insert.

Various combinations of outlet ports and nozzle inserts are possible. For example, each nozzle insert may have the same dimensions, and at least two of the outlet ports may have different dimensions such as the distance away from the outer surface of the body. Alternatively, each outlet port may have the same dimensions, and at least two of the nozzle inserts may have different dimensions such as the nozzle insert fluid delivery aperture diameter, or the nozzle insert tip depression maximum diameter and length.

Each nozzle insert may be secured in position in its associated outlet port by way of an interference fit with an inner surface of the outer end of its associated outlet port. Advantageously, the position of each nozzle insert, when secured in its associated outlet port, may be movable with respect to the inner surface of the outer end of its associated outlet port such that a spray cone angle of each nozzle insert can be varied.

In another aspect, the invention provides a device for spraying an inner surface of an enclosure with a liquid. The device includes a container for the liquid, a fluid delivery head, a conduit in fluid communication with the container and an inlet of a fluid chamber of the fluid delivery head, and fluid delivery means for delivering liquid from the container through the conduit and to the fluid delivery head. The fluid delivery head is constructed such that the liquid can be sprayed around a perimeter of the fluid delivery head. The fluid delivery head includes a plurality of outlet ports in fluid communication with the fluid chamber, and a nozzle insert secured in an outer end of each outlet port. At least one of the nozzle inserts has a fluid delivery aperture in fluid communication with an interior space of its associated outlet port for delivering fluid out of the interior space of its associated outlet port. Generally, each of the nozzle inserts has a fluid delivery aperture in fluid communication with an interior space of its associated outlet port. However, there may be circumstances where a nozzle insert is used to prevent fluid flow out of its associated outlet port and therefore, such a nozzle insert would not have a fluid delivery aperture.

In one configuration of the fluid delivery head of the device, one or more of the outlet ports are angled away from a plane normal to a longitudinal axis of the fluid chamber. The number of angled outlet ports is not limited, that is, every outlet port could be angled away from the plane normal to a longitudinal axis of the fluid chamber of the fluid delivery head. Each nozzle insert may include a fluid delivery aperture in fluid communication with the interior space of its associated outlet port for delivering fluid out of the interior space of its associated outlet port, and an outer tip of each nozzle insert may include an inwardly directed depression in fluid communication with the fluid delivery aperture. The inwardly directed depression, along with other things, creates the spray pattern from the fluid delivery head. For example, when each depression has a conical inner surface, the fluid delivery head creates a plurality of conical spray patterns.

Each nozzle insert may removably secured in position in its associated outlet port by way of an interference fit with an inner surface of the outer end of its associated outlet port. In one version of the fluid delivery head of the device, each outlet port has the same dimensions, and at least two of the nozzle inserts have different dimensions. In this version, the differing nozzle inserts are mainly used control the different spray patterns from the fluid delivery head. In another version of the fluid delivery head of the device, each nozzle insert may have the same dimensions, and at least two of the outlet ports may have different dimensions. In this alternative version, the differing outlet ports are mainly used control the different spray patterns from the fluid delivery head.

In one embodiment of the device, the container is pressurized, and the fluid delivery means includes a propellant in the container and a valve in the conduit, the valve having an open position for delivering chemical from the container through the conduit and to the fluid delivery head. In another embodiment of the device, the fluid delivery means includes a pump for delivering chemical from the container through the conduit and to the fluid delivery head when the pump is activated. Example pumps include vein pumps, impeller driven pumps, peristaltic pumps, gear driven pumps, bellows pumps, and piston pumps.

In one application of the device, the enclosure is a toilet bowl, and the device includes means for attaching the fluid delivery head on a rim of the toilet bowl. One suitable attachment means is a mounting clip formed from a flexible plastic that allows for expansion and contraction to accommodate various toilet bowl rim sizes. In another application of the device, the enclosure is a shower enclosure, and the device includes means for attaching the fluid delivery head near a wall of the shower enclosure. One suitable attachment means is a hanger that suspends the fluid delivery head from a shower pipe.

In yet another aspect, the invention provides a method for spraying a liquid on inner side surfaces of an enclosure. In the method, there is used a fluid delivery head including a fluid chamber and a plurality of outlet ports in fluid communication with the fluid chamber. Nozzle inserts are provided wherein at least some of the nozzle inserts have fluid delivery passageways of different internal dimensions. A nozzle insert is selected for each outlet port, and each selected nozzle insert is inserted into its associated outlet port. The fluid delivery head is positioned in the enclosure, and the liquid is delivered to the fluid chamber of the fluid delivery head such that the liquid is sprayed laterally around all inner side surfaces of the enclosure.

Preferably, at least two nozzle inserts having fluid delivery passageways of different internal dimensions are inserted in the outlet ports. The nozzle inserts are selected and inserted such that the pattern of the spray depends on the distance the spray has to travel before hitting the enclosure surface. For example, the nozzle insert which is going to be placed closest to the enclosure surface may be selected to have the maximum spray pattern angle, and the nozzle insert which is going to be placed farthest from the enclosure surface may be selected to have the minimum spray pattern angle.

Each fluid delivery passageway may include a fluid delivery aperture and an inwardly directed depression in fluid communication with the fluid delivery aperture. Preferably, the depression is in an outer end of the nozzle insert where the spray exits the nozzle insert. In one form, each depression has a conical inner surface.

These and other features, aspects, and advantages of the present invention will become better understood upon consideration of the following detailed description, drawings, and appended claims.

BRIEF DESCRIPTION OF THE DRAWINGS

Like reference numerals will be used to refer to like parts from Figure to Figure in the following description of the drawings.

DETAILED DESCRIPTION OF THE INVENTION

A fluid delivery head according to the invention can be used in various devices that spray liquid on the inside surfaces of an enclosure such as a toilet bowl, a shower enclosure, a bathtub enclosure, and the like. Certain embodiments of the invention are shown and described for the purposes of illustration and are not intended to limit the invention in any way.

Figure 1B:
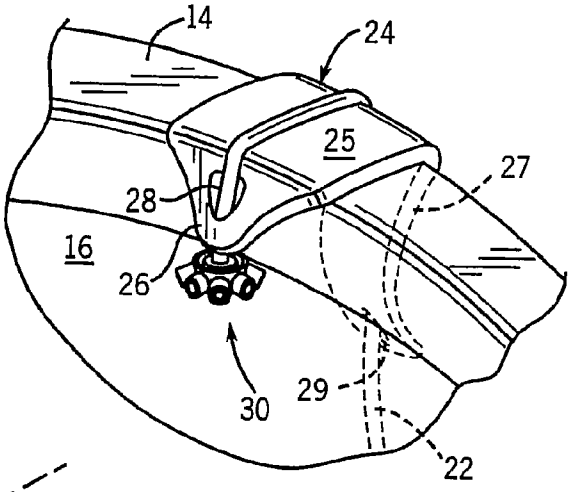
FIG. 1B is a partial perspective view taken along line 1B-1B of FIG. 1A showing a mounting clip and a fluid delivery head of the invention.
Figure 2:
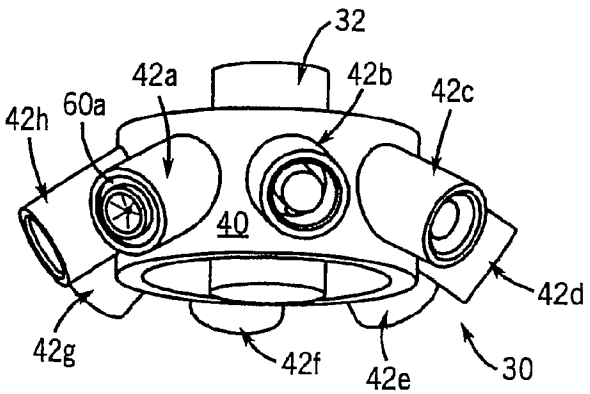
FIG. 2 is a bottom, side perspective view of a fluid delivery head according to the invention.
Figure 1A:
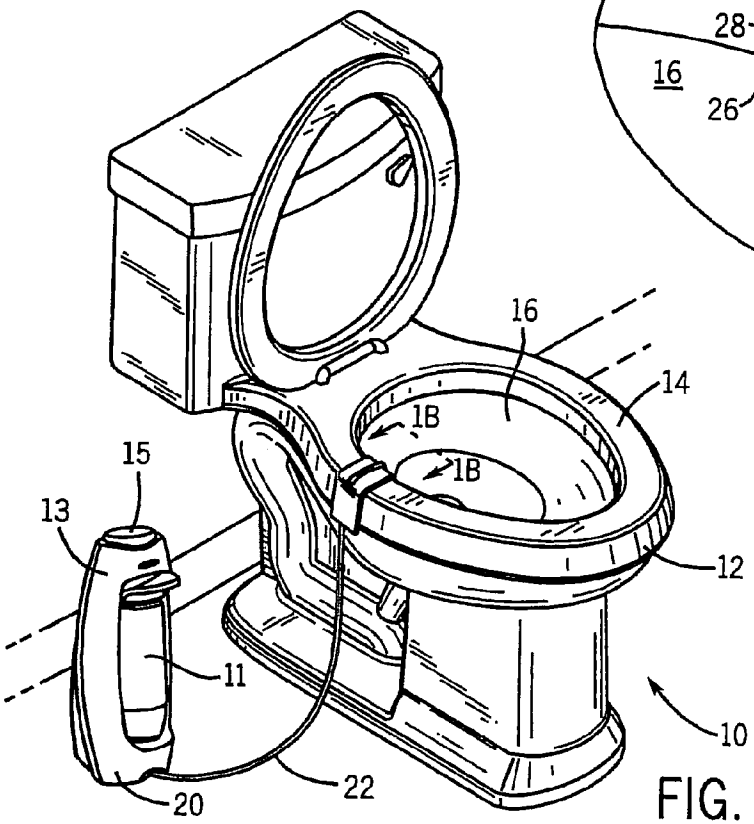
FIG. 1A is a perspective view of an example toilet bowl cleaning device in which a fluid delivery head according to the invention can be used.

Turning to FIGS. 1A and 1B, there is shown an example embodiment of an automatic toilet bowl cleaning device 10 that includes a fluid delivery head 30 according to the invention. The toilet bowl cleaning and/or deodorizing device 10 includes a container 11 for a chemical, a fluid delivery head 30 through which the chemical can be sprayed laterally around a perimeter of the fluid delivery head 30, a fluid supply conduit 22 in fluid communication with the container 11 and the fluid delivery head 30, and a mounting clip 24 for attaching the fluid delivery head 30 near the rim 14 of the toilet bowl 12 of the toilet. The chemical can be sprayed by the fluid delivery head 30 directly onto the inner surface 16 of the toilet bowl 12 and/or into the toilet water so as to continuously clean and deodorize the toilet bowl 12 as described below.

The container 11 is housed upside down in a case 13. A fitment is provided in the case 13 for engaging an outlet of the container 11. The fitment of the case 13 is also connected to the fluid supply conduit 22. The case 13 also includes a manual activator button 15. In one version of the invention, the container 11 is pressurized and includes a propellant in the container 11 and an outlet valve. The manual activator button 11 moves the valve into an open position for delivering chemical from the container 11 through the conduit 22 and to the fluid delivery head 30. For example, the activator button 15 pushes the container 11 downward such that the valve at the bottom of the container 11 opens. Alternatively, the chemical may be delivered from the container 11 to the conduit 22 by a pump. Also, delivery of the chemical from the container 11 to the conduit 22 may be controlled by a controller that initiates fluid delivery according to various programmed time schedules.

FIG. 1B shows the mounting clip 24 for attaching the fluid delivery head 30 near the rim 14 of the toilet bowl 12 of the toilet 10. The mounting clip 24 has a base wall 25, a first side wall 26, and a second side wall 27 spaced from the first side wall 26 to create an inverted generally U-shaped clip 24. The clip 24 is formed from a flexible plastic to allow for expansion and contraction to accommodate various toilet bowl rim sizes. The conduit 22 is threaded through a hole 28 in the first side wall 26, over the base wall 25, and through a hole 29 in the second side wall 27. This controls location of the conduit 22 to next to the mounting clip 24 and serves to hide part of the conduit 22. The fluid delivery head 30 engages an end of the conduit 22 as shown in FIG. 1B and receives chemical from the conduit 22.

When a user presses the manual activator button 15, the valve of the pressurized container 11 moves into an open position for delivering chemical from the container 11 through the conduit 22 and to the fluid delivery head 30. The chemical enters the fluid delivery head 30, is then sprayed laterally around the entire perimeter of the fluid delivery head 30 as described below. As a result, the chemical is uniformly spread around the entire perimeter of the inner surface of the toilet bowl. The configuration of the fluid delivery head 30 can be varied to directly spray chemical below the toilet waterline, and/or at the toilet waterline, and/or above the toilet waterline.

With respect to the device 10 described above, manual delivery of the chemical from the container to the conduit can be achieved in many different manners. For example, as described above, manual activation buttons or foot pedals can be used to move the valve of a pressurized container and deliver chemical into the conduit 22 and into the fluid delivery head 30. Alternatively, a manual trigger type sprayer, such as that shown in U.S. Pat. No. 4,618,077 can be used to introduce chemical from a container into the conduit 22 and into the fluid delivery head 30.

An electric motor driven sprayer such as that shown in U.S. Patent Application Publication No. 2005/0133540 can also be used to introduce chemical from a container into the conduit 22 and into the fluid delivery head 30. In this type of electric motor driven sprayer, batteries power a motor for a piston pump. A flexible pick-up tube extends from the container with the chemical. An air vent is provided from the sprayer back down to the container to vent the container as liquid is pulled out. The motor in the spray head housing drives a circular member with a radial projection. The projection rides in a slot of a cam follower up and down to drive a piston head forward and back in a piston cylinder adjacent the outlet nozzle. Suitable check valves permit flow from the container to the outlet in response to piston movement, yet prevent return flow from the piston chamber. The nozzle of such an electric motor driven sprayer could be connected to the conduit 22.

Automatic delivery of the chemical from the container to the conduit and into the fluid delivery head can be achieved in many different ways. When using a pressurized container with a tilt valve, chemical can be released from the container into the conduit and into the fluid delivery head using a control circuit and a solenoid. In particular, the control circuit can energize the solenoid and when energized, the core of the solenoid moves against (depresses) the tilt valve of the container to release the chemical from the pressurized container and into the conduit.

The control circuit may include a battery and a programmable time-of-day timer such that the solenoid is energized and chemical is released from the container into the conduit according to an adjustable time pattern. For instance, chemical may be released from the container into the conduit at eight hour intervals. Of course, such programmable time-of-day timers allow for any number of time periods between release of chemical into the conduit and spray nozzle. Thus, a control circuit with a programmable time-of-day timer provides for a continuous action toilet bowl cleaning system.

Other control circuits are also suitable. For example, the control circuit may include a processor in electrical communication with a proximity sensor that detects the presence of a person near the toilet. The processor includes a timing circuit such that the solenoid is energized and chemical is released from the container into the conduit at a time period after a person is no longer sensed near the toilet. For instance, the proximity sensor sends a signal to the processor that a person is near the toilet. When the person leaves, the proximity sensor sends another signal to the processor indicating that no person is now near the toilet. A countdown timer in the processor then delays release of chemical from the container into the conduit.

Automatic delivery of chemical from the container to the conduit can also be achieved using an electrically driven pump and a control circuit. For instance, the electrically driven pump sprayer of U.S. Patent Application Publication No. 2005/0133540 described above could include a control circuit with programmable time-of-day timer such that the pump operates according to an adjustable time pattern thereby delivering chemical from the container to the conduit and into the fluid delivery head.

Having described one example automatic toilet bowl cleaning device 10 that includes a fluid delivery head 30 according to the invention, one example embodiment of the static fluid delivery head 30 according to the invention can be described. All components of the fluid delivery head 30 may be formed from a thermoplastic material such as polyethylene or polypropylene using plastics molding techniques known in the art. The fluid delivery head 30 may be used at various fluid delivery pressures. In one example form of the fluid delivery head, fluid pressures such as 8 psi to 35 psi (55-241 kilopascals) are preferred.

Figure 3:
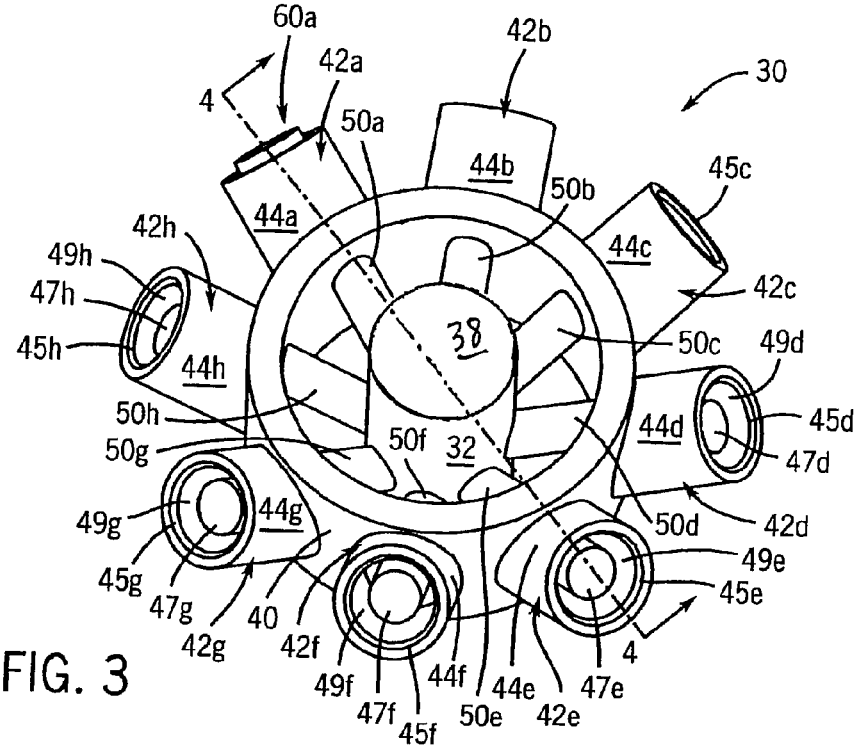
FIG. 3 is a bottom perspective view of the fluid delivery head of FIG. 2.
Figure 4:
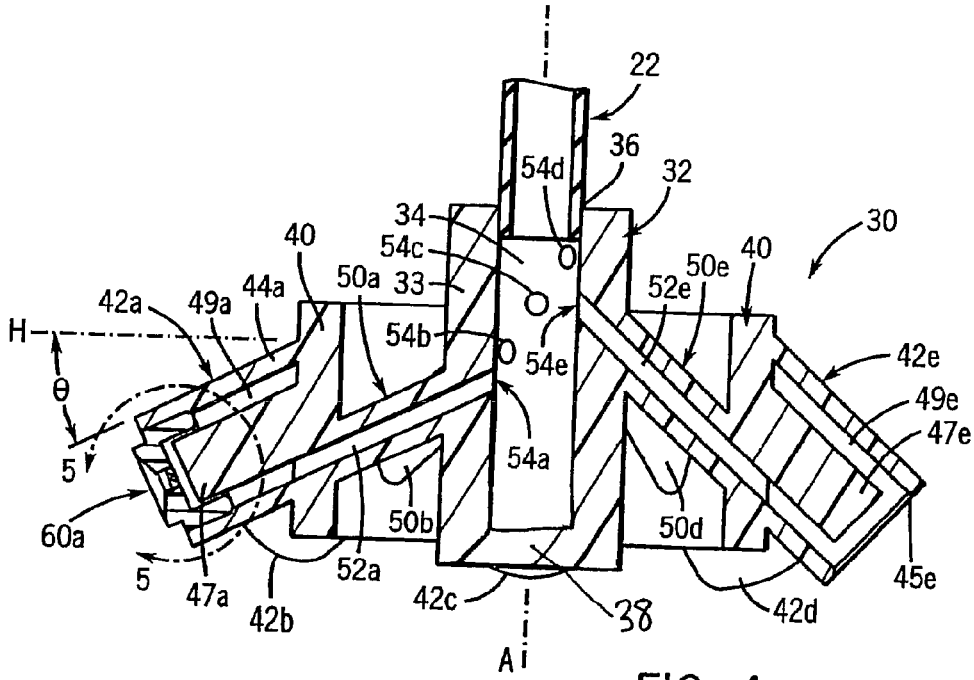
FIG. 4 is a sectional view of the fluid delivery head of FIG. 3 taken along line 4-4 of FIG. 3.
Figure 5:
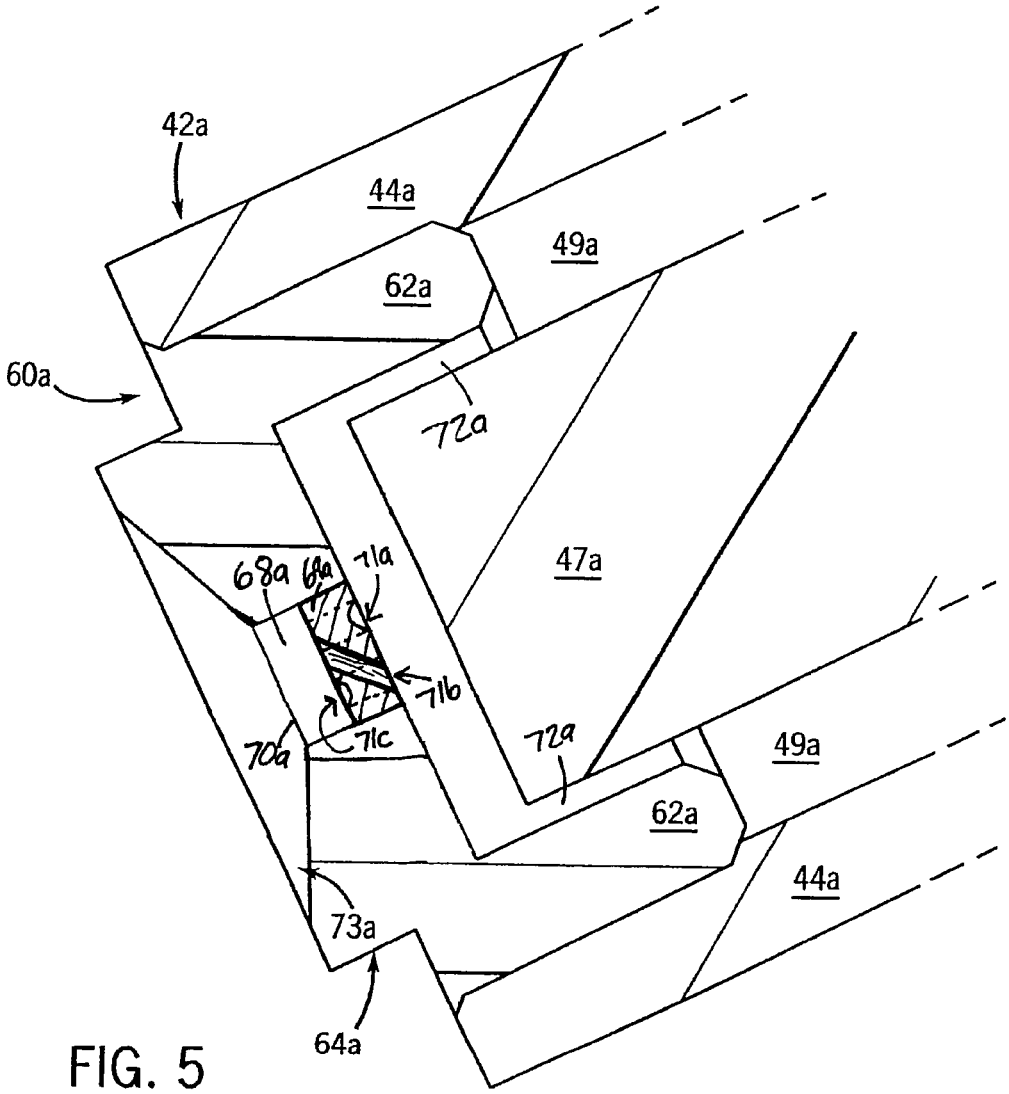
FIG. 5 is a detailed sectional view of the nozzle insert of the fluid delivery head of FIG. 4 taken along line 5-5 of FIG. 4.

Looking at FIGS. 3-5, the fluid delivery head 30 has a central tubular body 32 defined by an inner tubular wall 33. The body 32 defines a cylindrical fluid chamber 34 having an inlet opening 36 at one end and an end wall 38 at an opposite end. The fluid chamber 34 has a longitudinal axis A. The fluid delivery head 30 also includes an outer annular wall 40 that is spaced apart from the inner tubular wall 33.

Referring to FIG. 3, the fluid delivery head 30 has eight outlet ports 42*a*, 42*b*, 42*c*, 42*d*, 42*e*, 42*f*, 42*g*, 42*h* that are connected to and extend away from the outer annular wall 40. In the embodiment shown, the eight outlet ports 42*a* to 42*h* are circumferentially equally spaced around the outer annular wall 40. However, alternative spacings of the eight outlet ports 42*a* to 42*h* are possible. Each outlet port 42*a*, 42*b*, 42*c*, 42*d*, 42*e*, 42*f*, 42*g*, 42*h* has an outer tubular wall 44*a*, 44*b*, 44*c*, 44*d*, 44*e*, 44*f*, 44*g*, 44*h* respectively. Each outer tubular wall 44*a*, 44*b*, 44*c*, 44*d*, 44*e*, 44*f*, 44*g*, 44*h* has an inner chamfer 45*a*, 45*b*, 45*c*, 45*d*, 45*e*, 45*f*, 45*g*, 45*h* respectively at its outer end to facilitate insertion of a nozzle insert.

Each outlet port 42*a*, 42*b*, 42*c*, 42*d*, 42*e*, 42*f*, 42*g*, 42*h* also has an inner axial cylindrical projection 47*a*, 47*b*, 47*c*, 47*d*, 47*e*, 47*f*, 47*g*, 47*h* respectively. Each inner axial cylindrical projection 47*a*, 47*b*, 47*c*, 47*d*, 47*e*, 47*f*, 47*g*, 47*h* is spaced from its associated outer tubular wall 44*a*, 44*b*, 44*c*, 44*d*, 44*e*, 44*f*, 44*g*, 44*h* to thereby create an annular interior space 49*a*, 49*b*, 49*c*, 49*d*, 49*e*, 49*f*, 49*g*, 49*h* respectively in each outlet port 42*a*, 42*b*, 42*c*, 42*d*, 42*e*, 42*f*, 42*g*, 42*h*.

Each annular interior space 49*a*, 49*b*, 49*c*, 49*d*, 49*e*, 49*f*, 49*g*, 49*h* is in fluid communication with the fluid chamber 34 by way of flow conduits 50*a*, 50*b*, 50*c*, 50*d*, 50*e*, 50*f*, 50*g*, 50*h* respectively having associated flow passageways 51*a*, 51*b*, 51*c*, 51*d*, 51*e*, 51*f*, 51*g*, 51*h* that place the annular interior spaces 49*a*, 49*b*, 49*c*, 49*d*, 49*e*, 49*f*, 49*g*, 49*h* in fluid communication with the fluid chamber 34 by way of openings 54*a*, 54*b*, 54*c*, 54*d*, 54*e*, 54*f* (not shown), 54*g* (not shown), 54*h* (not shown) in the end of each flow conduit 50*a*, 50*b*, 50*c*, 50*d*, 50*e*, 50*f*, 50*g*, 50*h* respectively. Openings 54*a*, 54*b*, 54*c*, 54*d*, 54*e*, 54*f*, 54*g*, 54*h* may the same or different distances (as shown) from the end of the fluid chamber 34.

At least one the outlet ports 42*a*, 42*b*, 42*c*, 42*d*, 42*e*, 42*f*, 42*g*, 42*h* is inclined at an angle (⊖) from the horizontal plane H that is normal to the longitudinal axis A of the fluid chamber of the fluid delivery head (see FIG. 4). Preferably, each of the outlet ports 42*a*, 42*b*, 42*c*, 42*d*, 42*e*, 42*f*, 42*g*, 42*h* is angled away from the inlet 36 of the fluid chamber 34. Most preferably, each of the outlet ports 42*a*, 42*b*, 42*c*, 42*d*, 42*e*, 42*f*, 42*g*, 42*h* is angled away from the longitudinal axis A of the fluid delivery head 30. In other words, in the preferred embodiment, each of the outlet ports 42*a*, 42*b*, 42*c*, 42*d*, 42*e*, 42*f*, 42*g*, 42*h* is inclined at an angle (⊖) from the horizontal H away from the inlet 36. The angle (⊖) of each of the outlet ports 42*a*, 42*b*, 42*c*, 42*d*, 42*e*, 42*f*, 42*g*, 42*h* away from the horizontal plane H may be the same or may be different from other outlet ports. Thus, in the embodiment shown, there may anywhere from one to eight different angles (⊖) for each of the outlet ports 42*a*, 42*b*, 42*c*, 42*d*, 42*e*, 42*f*, 42*g*, 42*h*.

The length of each of the outer tubular walls 44*a*, 44*b*, 44*c*, 44*d*, 44*e*, 44*f*, 44*g*, 44*h* from the wall 40 to the end of each outer tubular wall 44*a*, 44*b*, 44*c*, 44*d*, 44*e*, 44*f*, 44*g*, 44*h* may be the same or may be different from other outlet ports. Thus, in the embodiment shown, there may anywhere from one to eight different lengths for each of the outlet ports 42*a*, 42*b*, 42*c*, 42*d*, 42*e*, 42*f*, 42*g*, 42*h*.

Each outlet port 42*a*, 42*b*, 42*c*, 42*d*, 42*e*, 42*f*, 42*g*, 42*h* has a nozzle insert in its outer end. For ease of description and illustration, FIGS. 3 and 4 only show nozzle insert 60*a* that is inserted in the outer end of outlet port 42*a*. It should be understood that each of outlet ports 42*b*, 42*c*, 42*d*, 42*e*, 42*f*, 42*g*, 42*h* also includes a nozzle insert in its outer end. The dimensions of each nozzle insert may be the same or may be different from other nozzle inserts. Thus, in the embodiment shown, there may anywhere from one to eight different sizes for each of the nozzle inserts.

Referring now to FIGS. 4 and 5, the nozzle insert 60*a* (as well as the other seven nozzle inserts which are not shown) has an annular side wall 62*a* that terminates at one end in a nozzle tip 64*a* having an inward depression 73*a* in the nozzle tip 64*a*. The nozzle insert 60*a* also has a cylindrical swirl chamber 68*a* in fluid communication with the inward depression 73*a* in the nozzle tip 64*a* by way of a fluid delivery aperture 70*a*.

Located in the swirl chamber 68*a* is a swirl insert 69*a* which has a number of slanted throughholes 71*a*, 71*b*, 71*c* located around the center of the swirl insert 69*a*. The swirl insert 69*a* may be press fit into the cylindrical swirl chamber 68*a*. Alternatively, the swirl insert 69*a* may be integral with the nozzle insert 60*a*. Thus, the fluid passageway in the nozzle insert 60*a* includes the slanted throughholes 71*a*, 71*b*, 71*c*, the swirl chamber 68*a*, the fluid delivery aperture 70*a*, and the conical depression 73*a* in the nozzle tip 64*a*. Generally, each of the nozzle inserts has a fluid passageway in fluid communication with an interior space of its associated outlet port. However, there may be circumstances where a nozzle insert is used to prevent fluid flow out of its associated outlet port, and in such circumstances a nozzle insert without a fluid passageway is used. Each nozzle insert is secured in position in its associated outlet port by way of an interference fit between the outer surface of the nozzle insert and the inner surface of the outer end of its associated outlet port. Other means for securing the nozzle insert in each outlet port are also suitable such as adhesives or threads.

Each nozzle insert can produce a different, but generally conical, spray pattern by way of altering various pressure swirl atomizer design parameters. For example, the spray pattern can be altered by altering: the number of throughholes, the inside diameter of the throughholes, the angle of the throughholes, the length of the throughholes, the swirl chamber inside diameter; the swirl chamber length, the conical depression depth; and the conical depression diverging angle. Also, when an interference fit is used, the position of each nozzle insert, when secured in its associated outlet port, is movable with respect to the inner surface of the outer end of its associated outlet port such that a spray cone angle of each nozzle insert can be varied.

In the version of the nozzle insert 60*a* shown in FIG. 5, fluid flow is as follows. Fluid passes from annular interior space 49*a* into annular space 72*a* in the nozzle insert 60*a*. Fluid then enters the slanted throughholes 71*a*, 71*b*, 71*c* of the swirl insert 69*a*. The passage of the fluid through the slanted throughholes 71*a*, 71*b*, 71*c* in the swirl insert 69*a* causes the fluid to swirl. The swirling fluid exiting the end of the slanted throughholes 71*a*, 71*b*, 71*c* is then impacted against the inner surfaces of the swirl chamber 68*a* which causes further swirling of the fluid. The fluid will then spread in a cone-shaped spray after leaving the conical inward depression 73*a* in the nozzle tip 64*a*.

While one version of a nozzle insert that produces a conical spray is shown, one skilled in the art will appreciate that other swirl nozzles may be used as the nozzle insert such as hollow cone simplex nozzles, solid cone simplex atomizers, and simplex swirl atomizers. See, e.g., nozzles shown in "Atomization and Sprays" by A. H. Lefebvre, Hemisphere Publishing Corp., New York, 1989.

Thus, various nozzle inserts can be provided for use in the fluid delivery head 30. Enclosures, such as toilet bowls, shower enclosures, and bathtub enclosures, typically have very different internal geometries depending on the model selected. By providing a number of different nozzle inserts, the spray pattern from each outlet port can be tailored by selection of the nozzle insert. Nozzle inserts which are going to be placed closest to the enclosure surface may be selected to produce larger spray pattern angles, and nozzle inserts which are going to be placed farthest from the enclosure surface may be selected to produce smaller spray pattern angles.

For example, the fluid delivery head 30 described above has eight outlet ports. When installed on the rim of a toilet bowl, each outlet port may be a different distance from the inner surface of the toilet bowl. Therefore, each of the eight nozzle inserts may be selected based on the distance of its associated outlet port from the inner surface of the toilet bowl. The outlet port which is placed closest to the toilet bowl surface will typically be provided with a nozzle insert that produces the largest spray pattern angle, and the outlet port which is placed furthest from the toilet bowl surface will typically be provided with a nozzle insert that produces the smallest spray pattern angle in order to carry the spray the further distance to the toilet bowl surface. It can be appreciated by one skilled in the art that the magnitude of the spray pattern angle selected generally varies inversely with distance to the toilet bowl surface and therefore, nozzle inserts that produce spray pattern angles between the maximum and the minimum spray pattern angle can be selected accordingly for outlet ports at different distances from the toilet bowl surface.

In order to facilitate the selection of nozzle inserts, each nozzle insert may include numerical indicia of an expected spray distance for the nozzle insert. When higher spray distances are necessary, nozzle inserts with higher numeric values may be chosen by a user. This may be beneficial when creating a catalog of nozzle insert selections based on the specific model of toilet bowl (or shower enclosure etc.). For example, a fluid delivery head may be mounted on the side of a specific model toilet bowl, and the distance of each outlet port from the inner surface of the toilet bowl may be measured. The fluid delivery head may include mounting arrows and numbering of the outlet ports to facilitate alignment of the fluid delivery head with the front (or any other reference point) of the toilet bowl. The measured distances may then be used to select nozzle inserts. A catalog of nozzle inserts for each numbered outlet port of the fluid delivery head for numerous models of toilet bowl can then be created.

Thus, the present invention provides a multiple nozzle differential fluid delivery head for spraying a cleaner on the inside surfaces of an enclosure such as a toilet bowl or a shower enclosure. As a result, full coverage of the cleaner around the inner surface of the enclosure is possible.

Although the present invention has been described in detail with reference to certain embodiments, one skilled in the art will appreciate that the present invention can be practiced by other than the described embodiments, which have been presented for purposes of illustration and not of limitation. Therefore, the scope of the invention should not be limited to the description of the embodiments contained herein.

INDUSTRIAL APPLICABILITY

The present invention provides a multiple nozzle differential fluid delivery head for spraying a cleaner on the inside surfaces of an enclosure such as a toilet bowl or a shower enclosure. When used in a manual or automatic cleaning system, the fluid delivery head can apply chemical to the entire circumference of the inner surface of the enclosure.

What is claimed is:

1. A device for spraying an inner surface of a toilet bowl with a liquid, the toilet bowl including an internal geometry with an inner surface, the device comprising:

a container for the liquid;

a fluid delivery head through which the liquid can be sprayed around a perimeter of the fluid delivery head, the fluid delivery head including a fluid chamber, a plurality of outlet ports in fluid communication with the fluid chamber, and a nozzle insert secured in an outer end of each outlet port, at least one nozzle insert having a fluid delivery aperture in fluid communication with an interior space of its associated outlet port for delivering fluid out of the interior space of its associated outlet port;

means for attaching the fluid delivery head on a rim of the toilet bowl;

a conduit in fluid communication with the container and an inlet of the fluid chamber; and fluid delivery means for delivering liquid from the container through the conduit and to the fluid delivery head;

wherein the outlet ports are configured to provide a tailored spray pattern of the liquid to the inner surface of the toilet bowl to provide full coverage of the internal geometry of the toilet bowl, each outlet port has the same dimensions, and at least two of the nozzle inserts have different dimensions.

2. The device of claim 1 wherein:

one or more of the outlet ports are angled away from a plane normal to a longitudinal axis of the fluid chamber.

3. The device of claim 1 wherein:

each nozzle insert includes a fluid delivery aperture in fluid communication with the interior space of its associated outlet port for delivering fluid out of the interior space of its associated outlet port, and a tip of each nozzle insert includes an inwardly directed depression in fluid communication with the fluid delivery aperture.

4. The device of claim 3 wherein:

each depression has a conical inner surface.

5. The device of claim 1 wherein:

each nozzle insert is removably secured in position in its associated outlet port by way of an interference fit with an inner surface of the outer end of its associated outlet port.

6. The device of claim 1 wherein:

the container is pressurized, and the fluid delivery means comprises a propellant in the container and a valve in the conduit, the valve having an open position for delivering chemical from the container through the conduit and to the fluid delivery head.

7. The device of claim 1 wherein:

the fluid delivery means comprises a pump for delivering chemical from the container through the conduit and to the fluid delivery head when the pump is activated.

8. The device of claim 7 wherein:

the pump is selected from the group consisting of vein pumps, impeller driven pumps, peristaltic pumps, gear driven pumps, bellows pumps, and piston pumps.

9. The device of claim 4 wherein:

a conical depression diverging angle of at least one depression is different than a conical depression diverging angle of at least one other depression.

10. The device of claim 4 wherein:

a depth of at least one depression is different than a depth of at least one other depression.

11. The device of claim 5 wherein:

a position of at least one nozzle insert with respect to the inner surface of the outer end of its associated outlet port is different than a position of at least one other nozzle insert with respect to the inner surface of the outer end of its associated outlet port.

12. The device of claim 1 wherein:

at least two nozzle inserts include at least one throughhole and at least two nozzle inserts with throughholes have a different number of throughholes.

13. The device of claim 1 wherein:

at least two nozzle inserts include at least one throughhole and an inner diameter of at least one throughhole in one nozzle insert is different than an inner diameter of at least one throughhole in a different nozzle insert.

14. The device of claim 1 wherein:

at least two nozzle inserts include at least one throughhole and an angle of at least one throughhole in one nozzle insert is different than an angle of at least one throughhole in a different nozzle insert.

15. The device of claim 1 wherein:

at least two nozzle inserts include at least one throughhole and a length of at least one throughhole in one nozzle insert is different than a length of at least one throughhole in a different nozzle insert.

16. The device of claim 1 wherein:

each nozzle insert includes a swirl chamber and an inner diameter of at least one swirl chamber is different than an inner diameter of at least one other swirl chamber.

17. The device of claim 1 wherein:

each nozzle insert includes a swirl chamber and a length of at least one swirl chamber is different than a length of at least one other swirl chamber.

* * * * *